US005119107A

United States Patent [19]

Wildey et al.

[11] Patent Number: 5,119,107

[45] Date of Patent: Jun. 2, 1992

[54] PLANAR MICROWAVE ANTENNA SLOT ARRAY WITH COMMON RESONANT BACK CAVITY

[75] Inventors: Christopher G. Wildey, Harpenden; David J. Iredale, Watford, both of England

[73] Assignee: The Marconi Company Limited, England

[21] Appl. No.: 482,532

[22] Filed: Feb. 21, 1990

[30] Foreign Application Priority Data

Feb. 24, 1989 [GB] United Kingdom ..... 8904302

[51] Int. Cl.[5] ..... H01Q 1/38; H01Q 13/08

[52] U.S. Cl. ..... 343/770; 343/778

[58] Field of Search ..... 343/778, 786, 770, 771, 343/767, 700 MS

[56] References Cited

U.S. PATENT DOCUMENTS

| | | | |
|---|---|---|---|
| 4,614,947 | 9/1986 | Rammos | 343/778 |
| 4,626,865 | 12/1986 | Rammos | 343/786 |
| 4,644,362 | 2/1987 | Rammos | 343/778 |
| 4,829,314 | 5/1989 | Barbier et al. | 343/778 |
| 4,878,060 | 10/1989 | Barbier et al. | 343/778 |
| 4,958,165 | 9/1990 | Axford et al. | 343/770 |

FOREIGN PATENT DOCUMENTS 0252779 1/1988 European Pat. Off. .

215240 3/1987 Japan .

*Primary Examiner*—Michael C. Wimer

*Attorney, Agent, or Firm*—Kirschstein, Ottinger, Israel & Schiffmiller

[57] ABSTRACT

A planar microwave antenna having a resonant back structure (22) constituting a common back plane cavity for an array (20, 27) of resonant slots (21). The back structure (22) comprises a sheet of metal having an arrangement of mechanically pressed projections forming lands (23). The projections extend towards the regions between the slots (21) of the array (20) and are so shaped and positioned that the lands (23) do not intrude into areas of the back plane exposed by the slots (21). The lands (23) provide a rigid support for the slot array (20) and reduce the dimensional tolerance problems encountered in antennas having a single flat back plate. Further, the projections reduce the number of possible degenerate waveguide modes to give an improved antenna performance. The provision of a common back cavity also enables a closer slot spacing than can be achieved when using individual cavities for each pair of slots. The back structure can be manufactured at low cost without recourse to specialist pressing techniques or the use of expensive alloys. A slot antenna incorporating the back structure is suitable for use in DBS (Direct Broadcast by Satellite) TV reception.

7 Claims, 3 Drawing Sheets

Fig. 1. (Prior Art.)

PLANAR MICROWAVE ANTENNA SLOT ARRAY WITH COMMON RESONANT BACK CAVITY

BACKGROUND OF THE INVENTION

1. Field of the Invention

This invention relates to planar microwave antennas and, in particular, to a rear cavity structure for such antennas.

2. Description of Related Art

Planar arrays of resonant slot elements combined with a suspended stripline feed network have been proposed as a potentially low-cost alternative to other microwave antennas. These arrays have the advantage that they are flat and slim as opposed to traditional dish reflectors. One class of planar arrays which is suitable for circular polarization uses an array of "slots" (actually in the form of circular or square apertures) with a resonant back structure to enhance the forward radiation and to provide good bandwidth and return loss from the individual feeds to each of the slots. In this form of antenna the back structure consists of an array of individual cavities, each aligned with one of the slots. Considerations such as operating frequency, antenna efficiency and sidelobe performance determine the size and spacing of the slots and their associated cavities.

For low-cost mass production the cavity structure should be pressed from a sheet of suitable metal such as steel or aluminium. However, owing to the constraints imposed by performance requirements, it has been found that such a structure cannot be manufactured without recourse to specialist pressing techniques or the use of expensive alloys.

Microwave theory has indicated that it is possible to replace the individual cavities such that some or all of the slots are served by a common cavity. Taken to its extreme this means that the array of cavities can be replaced by a single flat reflecting plate. A dual-slot antenna having this design is described in European Patent Publication No. 0 252 779 - see FIG. 1 therein. Here a single flat back plate 14 constitutes a common cavity for the two arrays of slots. The use of a flat back plate has the disadvantage that the antenna structure is less rigid and "sagging" of the slot array sheets means that the tight tolerances required for good microwave performance cannot be assured during manufacture or use. The use of insulating spacers to maintain the separation of the slots from the cavity plate can reduce the tolerance problems, but makes mass assembly of the antenna slow and undesirably complicated. Furthermore, in operation the flat back plate can support a number of degenerate waveguide modes which cause drop-outs or resonances in the microwave performance. In an alternative design described in the same European patent specification—see FIGS. 10 and 11 therein—it is proposed to replace the simple back plate with a structure in which an array of individual cavities—one for each pair of slots—is pressed out of a metal sheet. Although this form of back structure overcomes the problem of supporting the slot array to prevent sag, it requires expensive precision engineering in the formation of the individual cavities. Further, since the individual cavities are required to be larger in diameter than the slots, it imposes a restriction on the minimum separation of the slots and hence on the antenna performance.

SUMMARY OF THE INVENTION

The present invention is concerned with providing a planar microwave antenna in which the problems and disadvantages of the aforedescribed back structures are at least alleviated. In particular the invention proposes a back structure which can be pressed relatively inexpensively and yet which still provides good mechanical properties, controls degenerate modes and allows closer slot spacings than the known designs.

According to the invention a planar antenna comprises a planar assembly and a back structure, the planar assembly comprising parallel first and second layers, the first layer having an array of resonant slots and the second layer having a network of feed conductors associated with the slots, and the back structure comprising a conductive sheet having a plurality of discrete projections extending towards inter-slot regions of the first layer, the back structure providing a resonant cavity for each of the slots.

The back structure preferably comprises a metal sheet in which the projections are formed by pressing.

Preferably the projections are secured to the first layer at the inter-slot regions, so that the height of the projections determines the depth of the resonant cavity.

The resonant slots are preferably circular.

According to a feature of the invention, the projections have such size and shape and such position, relative to the slots, that they do not extend within the boundaries of the slots as projected on to the conductive sheet. In the case of a rectangular array of circular slots in equally spaced rows and columns, the maximum dimension of each projection, measured in a plane parallel to that of the conductive sheet, is less than $(1.41-b)$, where a is the distance between adjacent rows or columns and b is the diameter of each slot.

The projections may have circular cross-section.

According to one feature of the invention, for any given slot, projections in the vicinity of that slot serve to reduce the number of degenerate modes of operation in the section of the resonant cavity associated with that slot.

In a preferred embodiment of the invention, the planar assembly comprises a third layer having an array of resonant slots corresponding to and aligned with the slots in the first layer, the second layer being disposed between the first and third layers so that each feed conductor is associated with a pair of corresponding slots. The first, second and third layers may be mutually spaced by air, the second layer providing a suspended stripline feed network. Alternatively, the antenna may further comprise two layers of dielectric material respectively disposed between the first and second layers and the second and third layers.

BRIEF DESCRIPTION OF THE DRAWINGS

A planar antenna in accordance with the invention will now be described, by way of example only, with reference to the accompanying drawings, in which.

DETAILED DESCRIPTION OF THE PREFERRED EMBODIMENTS

Figure 1:
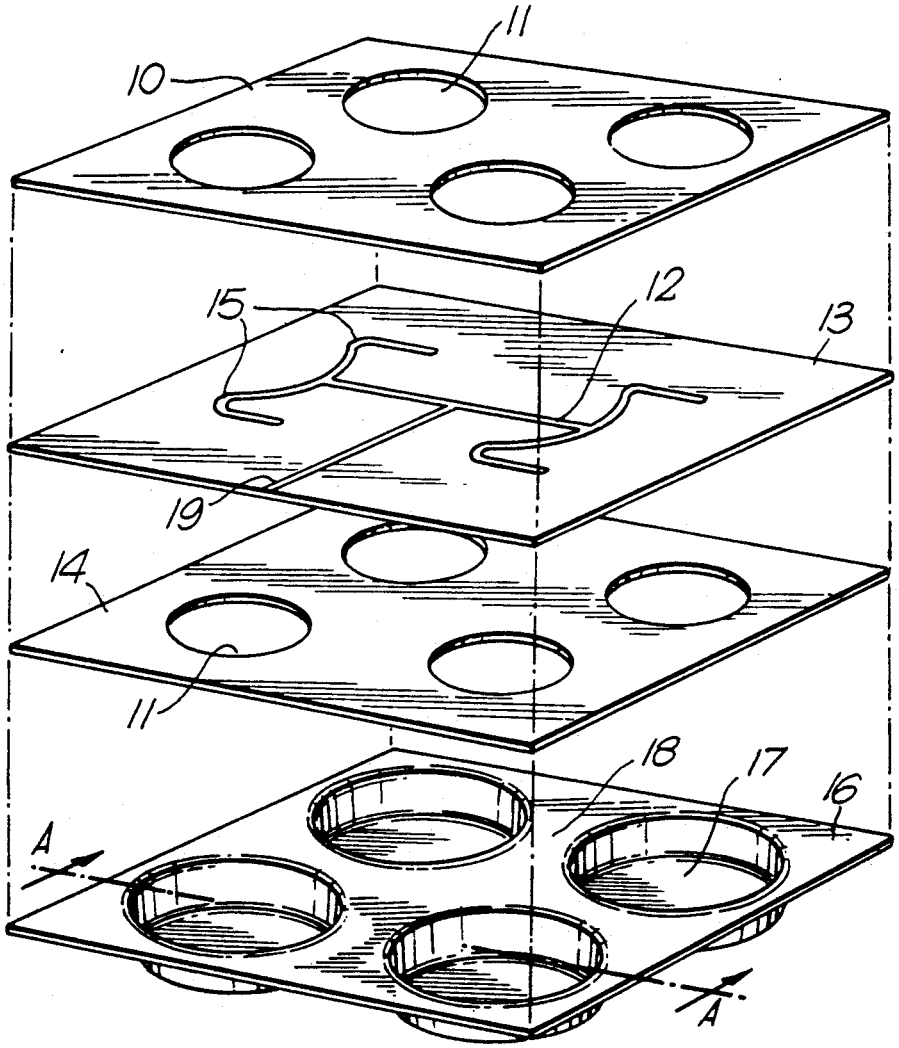
FIG. 1 is a perspective view of four elements of a known type of planar slot array antenna according to the Prior Art.

Referring now to FIG. 1 of the accompanying drawings, this shows a known type of planar slot array antenna, in which, for clarity, only 2×2 elements are shown. It will be appreciated that a practically useful antenna will generally comprise an array of this type, but having a much larger number (say, one hundred or more) of elements.

The antenna has an air-spaced tri-plate structure comprising a conductive upper slot array layer 10 and a conductive lower slot array layer 14, each layer having a matrix of four circular slots 11. Suspended between the two slot array layers 10,14 is a layer comprising a thin dielectric sheet 13 supporting a stripline feed network 12. Probes 15 formed at the ends of conductors in the feed network 12 provide means for coupling energy to or from the slots 11. The network 12 of feed conductors is connected to a common feed line 19 for the antenna. Each pair of slots 11 in the two layers 10,14 is aligned with an individual probe 15 in the feed network 12, that is to say each probe 15 lies within the boundary of a pair of slots 11 as projected onto the sheet 13. A back cavity array 16 is mounted behind the lower slot array layer 14 and has four quarter-wave cavities 17 of cylindrical form, each in alignment with one pair of the slots 11 and their associated probe 15.

It will be appreciated that the dimensions of this perspective view have been exaggerated in the interests of clarity. Further, the means of spacing the two layers 10,14 and the sheet 13 are not shown in FIGS. 1 or 2. The slots 11 can take alternative shapes and are not necessarily circular. Similarly, the configuration of the probes 15 shown in FIG. 1 is only one possible arrangement and is given by way of example. For instance, two orthogonal probes may be used for circular polarization.

Figure 2:
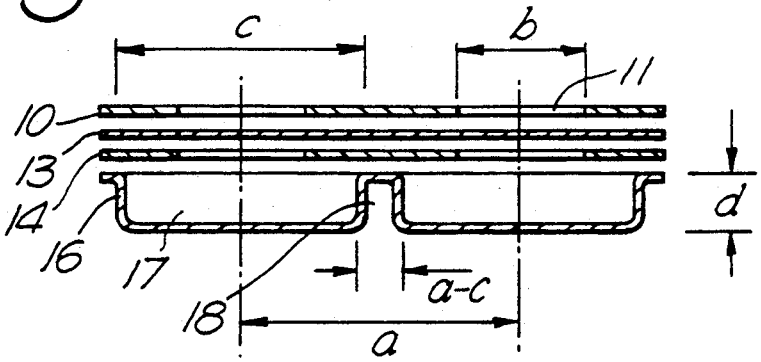
Fig. 2. (Prior Art)
FIG. 2 is a section taken on line A—A in FIG. 1.

FIG. 2 of the drawings is a section on line A—A in FIG. 1 and provides a more accurate illustration of sign mensions of the antenna. The dimension a is the spacing between the centres of adjacent slots 11 in a row or column. For high overall antenna efficiency and good sidelobe performance the slot spacing a should be less than one wavelength. If the spacing a exceeds one wavelength grating sidelobes are generated and there is also poor coupling between the incident wavefront and the slot elements.

In the antenna array shown in FIGS. 1 and 2, it is necessary for the diameter c of the cavities 17 to be greater than the diameter b of the circular slots 11. This requirement determines a value for a which is less than the optimum minimum value. The distance between the adjacent edges of the cavities 17 is thus (a-c) where a is greater than c and c is greater than b. The slot diameter b is typically 0.6 of a wavelength. The depth d of the cavities 17 is determined by the phase wavelength of the cavity. The difficulty of pressing the cavity array 16 from a single sheet of metal is caused by the stretch required to form the narrow walls 18 between adjacent cavities 17. The stretch at the minimum wall point is given approximately by $(a-c+2d) / (a-c)$. Typical values for an antenna designed to operate at 12 GHz, where the wavelength is 25 mm, are a=23 mm, b=15 mm, c=21 mm and d=9 mm. These figures yield a stretch factor of 10, for which specialist pressing techniques or expensive alloys are required in the manufacture of the cavity array 16.

Figure 3:
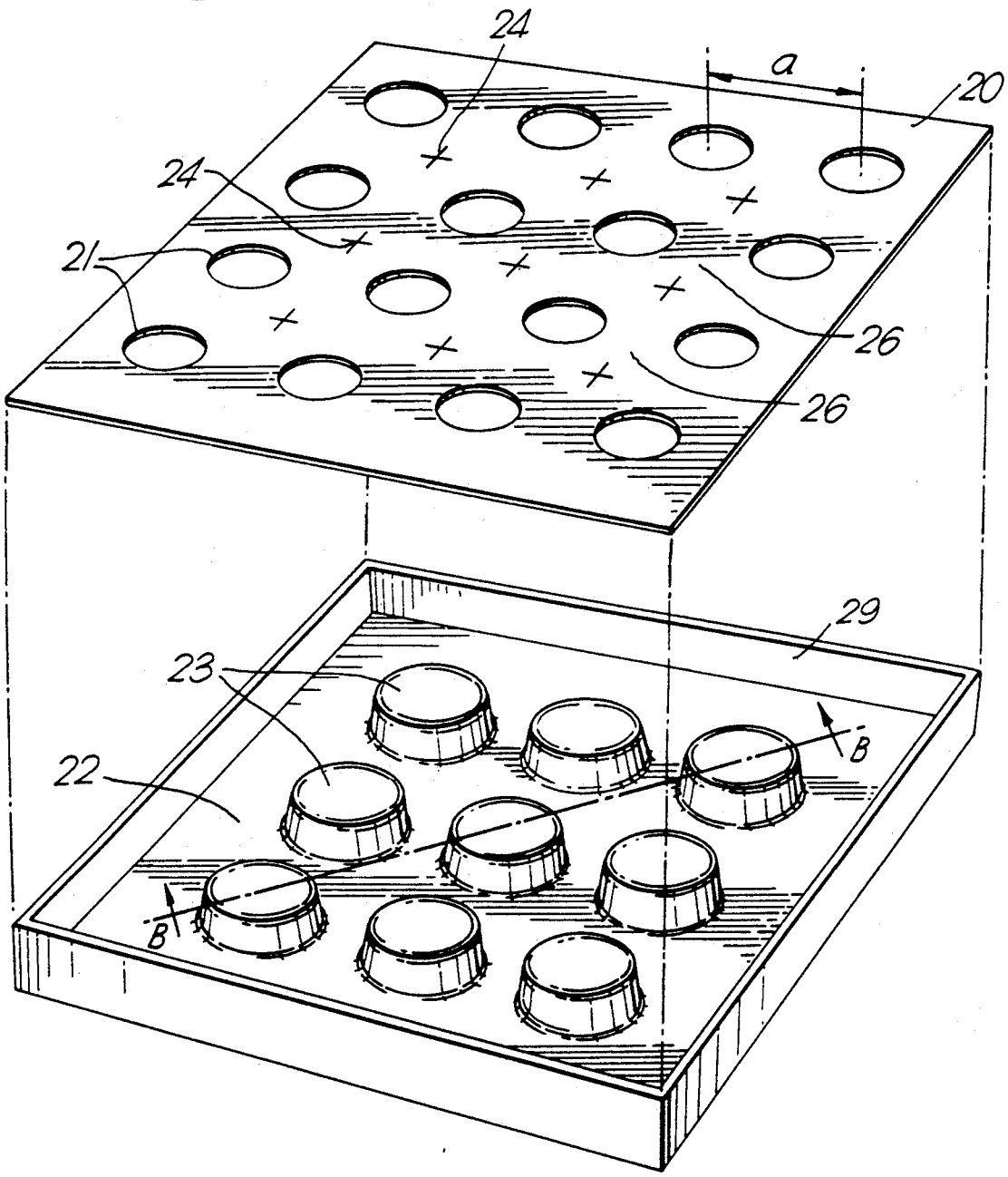
FIG. 3 is a perspective view of part of a 16-element planar antenna according to the present invention.

FIG. 3 of the accompanying drawings shows a 4×4 antenna array according to the present invention. However, in this figure the conductive upper slot array layer and suspended stripline sheet have been omitted; it will be appreciated that the upper slot array layer 27 (shown in FIG. 4) will be essentially the same as the conductive lower slot array layer 20, which has sixteen circular slots 21; that the stripline network supported on a dielectric sheet 28 (FIG. 4) will be similar in principle to the network 12 on the sheet 13 in FIG. 1, although, of course, in this case it will have 16 probes, each one aligned with a pair of slots 21 in the upper and lower slot arrays, all the probes again being connected to a common feed line for the antenna, as is known in the art.

Mounted behind the lower slot array is a back structure 22. The back structure 22 differs fundamentally from the cavity array 16 shown in FIGS. 1 and 2. Rather than having an array of individual cavities which correspond in number to, and are in alignment with, the circular slots, the back structure 22 features an arrangement of mechanically pressed discrete projections forming a plurality of lands 23. The back structure 22 may include a wall 29 (see FIG. 3) formed at its edges. However, the wall 29 is not an essential feature. The lands 23 are positioned so that they lie outside the boundaries of the slots 21 in the layer 20 as projected on the floor of the back structure 22, i.e. the flat part between the projections. From FIG. 4 it can be seen that the centre of each land 23 is in alignment with one of the inter-slot regions 26 centred on the crosses 24 marked on the lower slot array 20 in FIG. 3. The inter-slot regions 26 define the permissible positions of the lands 23 in the back structure 22. As can be seen from FIG. 3, the lands 23 are fewer in number than the slots in the array. The lands 23 can be shaped into any convenient form that will fit between the slots in the layer 20, and, for example, can be round, square or hexagonal in cross-section. Circular lands are shown in FIG. 3 by way of example. The actual size of the lands 23 is not critical to microwave function, but there is a restriction on their size that will now be described with reference to FIG. 4 of the drawings, which is a section on line B—B in FIG. 3.

Figure 4:
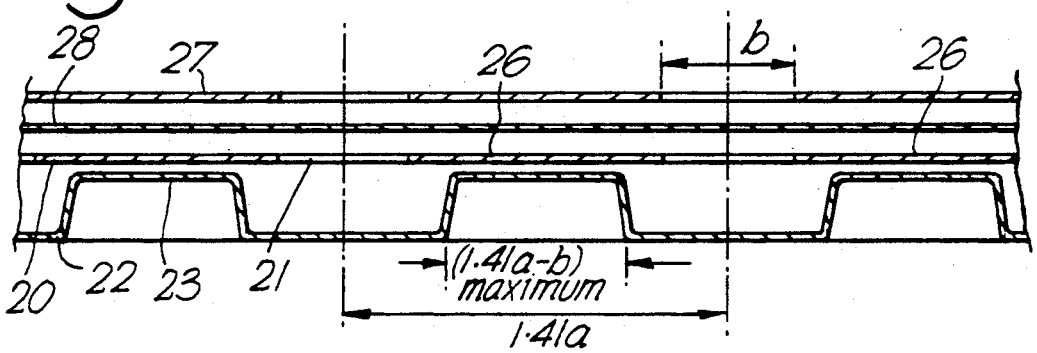
FIG. 4 is a section taken on line B—B in FIG. 3.

For completeness FIG. 4 including the upper slot array layer 27 and the suspended stripline sheet 28 omitted in FIG. 3. Essentially in the embodiment illustrated, i.e. having circular slots arranged in a rectangular array having equally spaced rows and columns, each land 23 should not have a major dimension which is greater than $(1.41a-b)$, where, as previously, a is the spacing of two adjacent slots 21 (as shown in FIG. 3) and b is the slot diameter. Meeting this requirement ensures that the lands 23 do not intrude into the floor of the back structure 22 exposed by the slots 21. It should be noted that the dimension $1.41a$ on FIG. 4 is the diagonally measured spacing of adjacent slots 21.

An advantage of the form of back structure 22 is that the spacing a between adjacent slots can be reduced, thereby increasing array efficiency, which rises to a maximum value at about a=0.75 of a wavelength. Furthermore, the maximum stretch of the metal required to fabricate the back structure 22 is now approximately $(1.41a-b+2d)/(1.4a-b)$. Using typical values for an antenna designed to operate at 12 GHz, i.e. with a=18.5 mm, b=15 mm, d=5 mm, the stretch factor is about 1.9, which is just within the capabilities of normal press techniques and low-cost materials. Note that the depth d of a cavity structure has a different value here to that given in the earlier example because its value is determined, inter alia, by the nature of the cavity itself. The lands 23 can be formed in a variety of shapes and can be used for both mode control, i.e. to reduce the number of degenerate modes, and to provide mechanical fixing to the lower slot array layer. Small variations in dimensions or distortions of the overall array no longer significantly affect the microwave performance of the antenna. Thus, it can be seen that the proposed back structure offers a number of significant advantages over the known flat back plate.

The lower slot array layer 20 is secured to the lands 23 of the cavity structure 22 at the points 24 in the inter-slot regions 26. A mechanical fastening is preferred, for example by means of rivets or self-tapping screws. Electrical connection between the cavity structure 22 and layer 20, whether at the inter-slot regions 26 or at the perimeter of the antenna, is not essential, but may provide some performance benefit. It should be noted that for reasons of clarity the means of fastening the back structure 22 to the slot aray 20 is not shown in FIG. 4. The height of the projecting lands 23, i.e. the extent to which they project above the floor of the back structure 22, determines the spacing between the cavity floor and the lower slot array 20, and hence is critical in ensuring a uniform cavity depth across the plane of the antenna.

Figure 5:
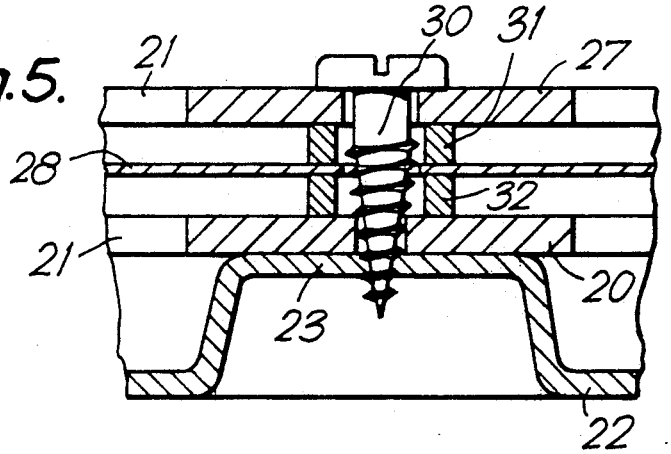
FIGS. 5 and 6 show constructional details of the antenna shown in FIGS. 3 and 4.
Figure 6:
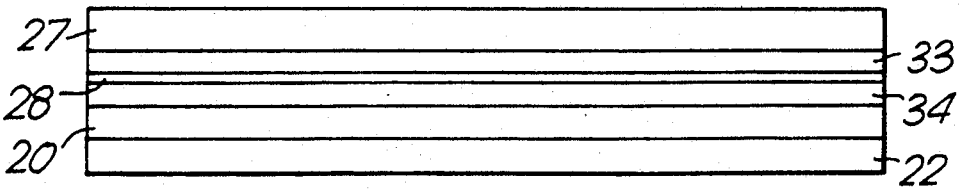

The dielectric sheet 28 supporting the feed network for the antenna and the upper slot array layer 27 may be secured at their perimeters to the edge of the back structure 22. For this purpose, plastic snap-fit connectors may be used. The critical relative spacings of the sheet 28 and the two slot array layers 20,27 can be ensured by the use of insulating spacers as required. If self-tapping screws are used as aforesaid to fasten the back structure, these screws 30 may also pass through the spacers 31,32 so as to secure all four major components of the antenna. This arrangement is shown in a sectional view of one projection 23 in FIG. 5. If the screw 30 is metallic, it will electrically short the two slot array layers 20,27 to the back structure 22. However, this is not an essential requirement. Alternatively, uniform spacing of the two slot array layers 20,27 about the feed network sheet 28 can be achieved by the introduction of two intervening layers of dielectric foam 33,34 or other material as shown in a side view (with exaggerated thickness) in FIG. 6. In this construction the component layers of the antenna may be clamped together at their edges.

Although the invention has been described with reference to a dual-slot antenna having an air-spaced or dielectric-filled tri-plate structure, it will be appreciated that the back structure disclosed, having an arrangement of lands pressed out of a single sheet of metal, may be incorporated into other antenna arrays requiring a back cavity. Further, in the dual-slot antenna described, the slots need not be circular, but may take any other convenient shape, square for example, with the proviso only that the projections in the back structure are formed in such shape and position that they do not intrude within the projected boundaries of the slots. It should be noted that whereas a "dual-slot" antenna includes, as the name implies, two slot arrays, the use of two slot arrays, as in the embodiment described, is not essential. Thus, one of the slot array layers can be omitted provided that a suitable feed network is included for the single layer of slots. If the upper slot array layer is omitted, the construction of the antenna remains essentially the same, having, for example, a fastening arrangement similar to that shown in FIG. 6. If, however, the lower slot array layer is omitted, the feed network sheet 28 is then sandwiched between the back structure and the slot array. Although the sheet 28 could be secured directly to the back structure 22 at the lands 23, it is preferable to mount it by means of spacers or, more conveniently, using an intervening layer of dielectric material. This saves the need to increase the height of the lands 23 to maintain the required cavity depth, i.e. the separation between the feed probes and the cavity floor being a quarter wavelength at the operative frequency.

We claim:

1. A planar microwave antenna, comprising:

(a) a planar assembly;

(b) a resonant back cavity structure;

(c) said planar assembly comprising a first slot array, a second slot array parallel to said first slot array, and a fed array disposed between the two slot arrays;

(d) said first slot array and said second slot array comprising respective first and second conductive sheets, each conductive sheet having an array of resonant slots separated by inter-slot regions o the sheet;

(e) said feed array comprising a dielectric sheet providing an array of feed conductors disposed in correspondence with the resonant slots in said first slot array and said second slot array;

(f) said resonant back cavity structure comprising a third conductive sheet including a flat floor section spaced from, but parallel to, said planar assembly, and a plurality of discrete projections spaced apart from one another and extending from said flat floor section toward the inter-slot regions in said first slot array for providing mutual support between said planar assembly and said resonant back cavity structure;

(g) said resonant back cavity structure providing a common resonant cavity for all the slots in said first and second slot arrays; and (h) said feed conductors being coupled together to provide a common antenna feed.

2. A planar microwave antenna according to claim 1, said projections to said firs slot array at said inner-slot regions.

3. A planar microwave antenna according to claim 1, wherein said first and second slot arrays are respectively spaced from said feed array by air, said feed array providing a suspended stripline feed network.

4. A planar microwave antenna according to claim 1, said planar assembly further comprising two layers of dielectric material respectively disposed between said first slot array and said feed array and between said second slot array and said feed array.

5. A planar microwave antenna according to claim 1, wherein said resonant slots are circular.

6. A planar microwave antenna according to claim 1, wherein each of said resonant slots is defined by a boundary in one of said fist and second conductive sheets, said projections having such size and such position, relative to the size and position of said resonant slots, that they do not extend into any said boundary as projected onto said third conducive sheet.

7. A planar microwave antenna according to claim 1, wherein said discrete projections have circular cross-section in a plane parallel to said fist and second conducive sheets.

* * * * *